United States Patent [19]

Chao

[11] 4,251,163

[45] Feb. 17, 1981

[54] KNOCK-OUT TYPE AUTOMATIC PENCIL

[76] Inventor: Wen-Kuei Chao, No. 47, Chung Cheng Rd., Ying Ko, Taipei Hsien, Taiwan

[21] Appl. No.: 22,629

[22] Filed: Mar. 21, 1979

Related U.S. Application Data

[62] Division of Ser. No. 762,784, Jan. 25, 1977, Pat. No. 4,153,379.

[51] Int. Cl.[3] ..... B43K 29/06

[52] U.S. Cl. ..... 401/50; 401/65

[58] Field of Search ..... 401/50, 65, 67, 92, 401/94

[56] References Cited

U.S. PATENT DOCUMENTS

| | | | |
|---|---|---|---|
| 1,848,224 | 3/1932 | Schmid | 401/94 |
| 2,358,091 | 9/1944 | Lovejoy | 401/67 X |
| 2,823,644 | 2/1958 | Van Den Bussche et al. | 401/94 |
| 3,813,175 | 5/1974 | Katz | 401/65 |
| 3,922,098 | 11/1975 | Katz | 401/65 |
| 3,945,733 | 3/1976 | Edel | 401/65 |

FOREIGN PATENT DOCUMENTS

| | | | |
|---|---|---|---|
| 1929615 | 6/1971 | Fed. Rep. of Germany | 401/65 |

*Primary Examiner*—Robert W. Michell
*Assistant Examiner*—J. L. Kruter
*Attorney, Agent, or Firm*—Burns, Doane, Swecker & Mathis

[57] ABSTRACT

Knock-out type automatic pencil comprises an outer barrel, an inner tube of plastic material molded integrally with a clamp and a head, a stopper collar inside the front end of outer barrel which retains the inner tube, a press device at the rear end of the outer barrel having lead sharpening and erasing means provided. The clamp at the front end of inner tube is formed in a closed type with slots on it instead of the conventional claw type.

4 Claims, 13 Drawing Figures

KNOCK-OUT TYPE AUTOMATIC PENCIL

This is a division of application Ser. No. 762,784, filed Jan. 25, 1977, now U.S. Pat. No. 4,153,379, issued May 8, 1979.

FIELD OF INVENTION

The present invention relates generally to knock-out type automatic pencil and more particularly to an automatic pencil having its inner tube, lead clamp and head formed integrally with plastic material, an outer barrel having a stopper collar formed inside its front end to prevent the lead from retracting, and, at the rear end of the outer barrel, a press device having lead sharpener and eraser built-in. The said clamp at the front end of the inner tube is of obturating type with slots on it instead of conventional split claw type.

BACKGROUND OF INVENTION

The conventional knock-out type automatic pencil usually has its inner tube which contains the pencil lead, its clamp which holds the lead and its head which serves as guide and protection to the lead made into individual parts. Fabrication of these parts and assembling thereof are quite complicated, thus resulting in high manufacturing cost. In addition, the head part and the clamp of inner tube are assembled with respective male-female threads formed at a fixing collar and the front end of the outer barrel. The improper assembling and the movement during writing would cause the threading to loose thereby changes the length of threading between the head with inner tube and the fixing collar, or between the fixing collar and the outer barrel. It is therefore difficult to assure the proper advancing of the lead, too short or too long of the extrusion of lead makes the lead easily to be broken. Besides, the said parts are usually made of metal such as copper, the cost of which is comparatively higher. The manufacturing of a claw-type clamp which splits at the front end, requires machinery of high precision, which in turn calls for a higher investment in manufacturing equipment.

In view of the abovesaid drawbacks, the present inventor has developed a novel knock-out type automatic pencil with improved structure, namely, to have the inner tube, clamp and the head made into an integrate assembly with plastic material.

SUMMARY OF INVENTION

Therefore, the main object of the present invention is to provide a knock-out type automatic pencil, wherein the inner tube, the clamp and the head are made integrally with plastic material. The improved construction simplifies the manufacturing and consequently results in a lower cost.

Another object of the present invention is to provide a knock-out type automatic pencil, of which the advancing distance of the lead is definite and the lead itself is stably held without vibration.

Still another object of the present invention is to provide a knock-out type automatic pencil, wherein a stopper collar is disposed between the outer barrel and the head to prevent the lead from retracting.

A further object of the present invention is to provide a knock-out type automatic pencil wherein the press device is provided with lead sharpener and eraser to facilitate usage.

Still a further object of the present invention is to provide a knock-out type automatic pencil wherein the clamp is of double cone shape, and slots are formed thereon to the effect that the holding of the lead is done by the tightening and releasing of the slots.

Other objects and features will become apparent from the following detailed description to be given in conjunction with the annexed drawings.

DETAILED DESCRIPTION OF EMBODIMENTS

Figure 1:
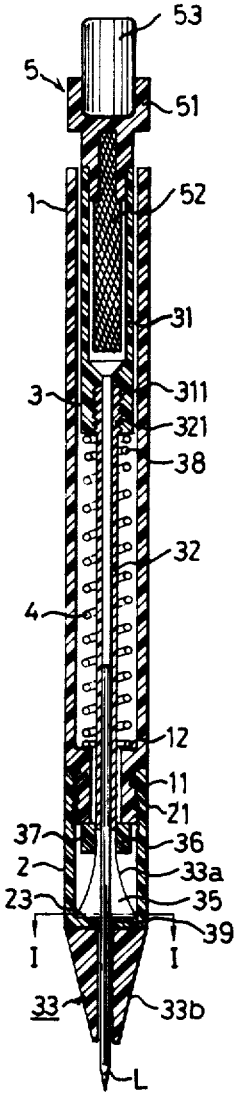
FIG. 1 is a longitudinal section of a first embodiment of the knock-out type automatic pencil of the present invention.
Figure 2:
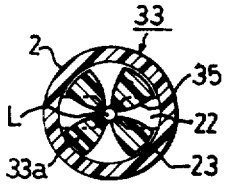
FIG. 2 is a cross sectional view taken along line I—I in FIG. 1.
Figure 3:
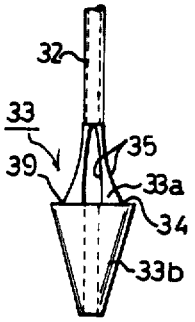
FIG. 3 is a front view of the clamp for lead.
Figure 4:
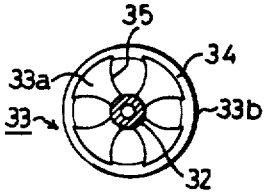
FIG. 4 is a top view of the said clamp.

Now referring to FIGS. 1 to 4, the pencil of the present invention comprises an outer barrel 1, front end of which (lower end in the drawing, has a retracted diameter section with male thread 11 outside it. The retracted diameter section forms an inner circular seat 12. A stopper collar 2 with female threads 21 inside its upper end is screwed on the abovesaid male thread 11 to extend from the outer barrel 1. Referring to FIGS. 2, at least two pinching members 22 project vertically inward from the lower wall of the collar 2 toward the center, the tip of each member 22 has curved recess 23 to facilitate the holding of lead L. Retained in the outer barrel 1 is an inner tube assembly 3 which consists of a rear end tube section 31 having larger inside diameter on the upper end to retain a press device 5, the lower end having smaller inside diameter with female threads 311 on it. A small pencil-lead receiving tube 32 is screwed to the said female threads 311 with male threads 321 formed outside its upper end. The inside diameter of pencil-lead receiving tube 32 is just big enough to let pass of a single pencil lead. A clamp 33 is formed at the front end of the tube 32 and projected out the front end of the stopper collar 2. The clamp 33 comprises a conical clamp portion **33*a* extending from the front end of tube 32, and right under the conical clamp 33*a* an inverted conical head 33*b* of larger diameter is formed. The said tube 32, clamp 33*a* and head 33*b* are formed into an integrated assembly with plastic material. Of course it is also feasible if let the clamp 33*a*** and head 33*b* be formed together and let tube 32 and rear section 31 be formed together, then jointed by suitable means such as screwing up ward.

At least two slots 35 extend upwardly from the junction of clamp 33*a* and head 33*b* along the wall of conical clamp 33*a*. These slots may be of any geometric form such as rectangular, trapezoidal, inverted T, and spaced symmetrically. The clamp 33*a* is retained inside the stopper collar 2 and the tips of pinching members 22 insert right into the slots 35 to frictionally engage with the lead L. A control ring 37 having tapered opening 36 is enclosing the upper end of the clamp portion 33*a* to control the opening and closing of the clamp 33. The said ring 37 is capable of sliding back and forth along the axis of inner tube 3.

Surrounding the pencil-lead-receiving tube 32, a coil spring 4 is retained in the outer barrel between the circular seat 12 and another circular seat 38 formed in front of the rear end tube section 31. The spring 4 constantly forces the inner tube 3 toward the rear end of the outer barrel 1, so that the flange 39 at upper end of head 33*b* would press tightly against the front end of the stopper collar, and makes the inner tube assembly 3 and the outer barrel combined into one body. Since the flange 39 of the head 33*b* is hampered by the stopper collar 2, the head 33*b* thus projected outside of the barrel. This construction is entirely different from the conventional one which was assembled by a lot of parts and screwed up the front head.

A press device 5 is inserted tightly at the rear end of the inner tube assembly 3. The said press device 5 is composed of a stepwise tubular body 51, a lead sharpener 52 inserted into the lower end of the tube 51, and an rubber eraser fixed onto the enlarged upper end of the tube 51. The lead sharpener may be a rod of metallic file or formed with certain abrasive material and having cross section such as rectangular, triangular, semi-circular or any other practical shape, yet the erasing rubber may be better in cylindrical form.

In using, press down the press device 5 first, insert lead from front end of the head 33*b* into the tube 32, then release the press device 5, the tip of lead L will project out of the head 33*b* in proper length. Since the spring 4 pushes the inner tube 3 up, the control ring 37 would naturally tighten up the clamp 33*a*, forcing the slots 35 of the clamp 33*a* under a tight condition to pinch or hold tight the lead there-between. The operation is just the same as that of a conventional knock-out type automatic pencil by pushing the device 5. Yet in the present invention, when the device 5 is being pressed, the inner tube assembly 3 moves forward with the control ring 37 and lead L. Since the lead L is clamped tight due to the tightening up of the ring 37, the lead would be able to overcome the smaller friction exerted by the pinching member 22 of stopper collar 2 and move forward. As soon as the control ring is stopped by the inner side of pinching member 22 of stopper collar 2, the clamp 33 still moves forward with the inner tube 3, causing the release of wedge effect between clamp 33*a* and control ring 37. Clamp 33 releases lead L until the lower surface of enlarged portion of the press device 5 gets in touch with the upper end of the outer barrel, the inner barrel 3 with clamp 33 stops moving forward. Once the press device 5 is released, the inner tube 3 retracts under the force of spring 4 and resumes its original condition. Yet the lead L stays unmoved due to its being released from the clamp 33 and pinched by the pinching member 22 of the stopper collar 2 and without retracting with the inner tube. Therefore, the length of lead L projected from the inner tube 3 would equal to the small distance D measured from the lower end of control ring 37 to the inner side of the pinching member 22 of the stopper collar 2. Upon retracting of inner tube 3, the clamp 33 would retract with control ring 37 until the said ring 37 is hampered at front end of outer barrel 1. However, the clamp continues to retract under the influence of the spring 4, then the control ring 37 once again tightens the clamp 33 by wedge effect, lead L is clamped once more. By this time, the pencil is ready for writing and the lead L would not retract into inner tube 3. From now on, through every push of press device 5, lead L would advance a designated length. After finished writing, the only thing to do is to push the press device, release the lead from clamping, press the lead tip lightly against any surface. The lead would then retracted into the tube 32 for protection.

Figure 5:
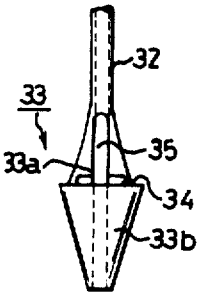
FIG. 5 is a front view of another embodiment of the clamp.
Figure 6:
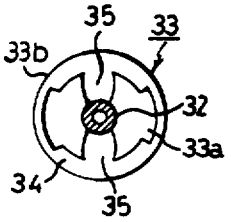
FIG. 6 is a top view of the clamp shown in FIG. 5.

FIGS. 5 and 6 depict another embodiment of the clamp 33 wherein the slots 35 are made into an inverted T shape, which makes the clamp more flexible in control.

Figure 7:
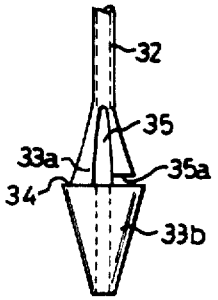
FIG. 7 is a front view of a further embodiment of the clamp part.

FIG. 7 shows another embodiment of clamp 33 wherein a lateral cutting 35*a* is provided at the junction between the clamp 33*a* and head 33*b* to connect one side of the pair of slots 35-35 together. This modification aims at enlargement of the opening capability of the clamp 33 not being limited by the shape and size of the slot 35.

Figure 8:
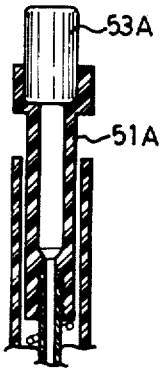
FIG. 8 is a longitudinal section showing the main parts of a second embodiment of the knock-out type automatic pencil of the present invention.
Figure 8:
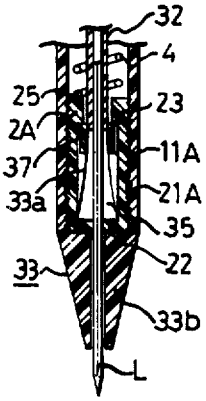
Figure 9:
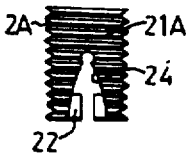
FIG. 9 is a front view of the stopper collar shown in FIG. 8.

FIGS. 8 and 9 depict a second embodiment of the pencil of the present invention. In this embodiment, the outer barrel 1A is of tubular form. Female thread 11A is provided at front end. The inside diameter of the stopper collar 2A is made so that the inside diameter of upper section is smaller than that of the lower section. At the junction of these two sections, a circular seat 23 is formed. At lower section of the collar at least two pinching members 22 are provided, the outside circumference of the collar is fully male threaded like 21A, and two inverted V shaped openings 24 are disposed for the convenience of inserting of both control ring 37 and inner tube 32 from under the collar 2A. The stopper collar 2A so constructed is to be screwed in the front end of the outer barrel 1A and retained therein to cover up the openings 24. The control ring 37 is pre-inserted as abovesaid into the collar 2A and being capable of moving freely at a space between the circular seat 23 and the pinching members 22. Spring 4 is retained between the circular seat 38 at the upper part of inner tube 3 and the circular seat 25 on top of the collar 2A.

Figure 10:
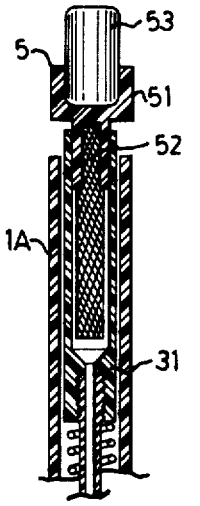
FIG. 10 is a sectional view of another embodiment of the stopper collar.
Figure 10:
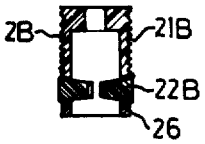

FIG. 10 depicts another embodiment of the stopper collar, wherein the stopper collar 2B is formed in a cylinder having smaller inside diameter at upper end. The outside of the collar 2B is also threaded as 21B. The two pinching members 22B are made separately with wedge type pins instead of being formed integrally with the collar body. These pins 22B are to be freely inserted into tapered holes 26 disposed surrounding the wall of the collar 2B. This construction facilitates easier assembling of control ring 37 and clamp 33 into the collar 2B. The wedge pins 22B are inserted after the control ring 37 is inserted.

Figure 11:
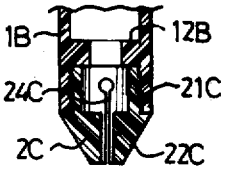
FIG. 11 is a longitudinal section showing another embodiment of the stopper collar and outer barrel.

FIG. 11 depicts another embodiment of the stopper collar and outer barrel, wherein the upper section of the stopper collar 2C is of cylindrical shape with threads 21C outside, the lower section of the stopper collar 2C is formed into conical portion 22C with a base of enlarged diameter. The inner wall of the conical portion has a pair of pinching members 22C disposed oppositely to hold the lead. Further, between the pair of pinching members 22C, a pair of slits 24C are disposed oppositely at front and rear. With such a structure of stopper collar 2C, the control ring (not shown) may be inserted within the collar from atop and then the collar is screwed into the female threaded hole provided at front end of the outer barrel 1B. A circular seat 12 is formed inside the outer barrel 1B, the upper side is served as spring retainer, the lower side is matched with the pinching member to control the up-down movement of the said control ring.

Figure 12:
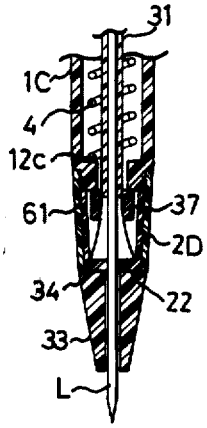
FIG. 12 is a partial longitudinal section showing the main parts of a third embodiment of the knock-out type automatic pencil of the present invention.

FIG. 12 depicts a third embodiment of the pencil of the present invention, wherein the outer barrel 1C and the stopper collar 2C are formed integrally. The collar 2D in tapered form also comprises spring retaining set 12C, the space for containing control ring 37, several pinching members 22 and a pair of V opening. A sleeve 61 is screwed up outside the collar 2D to cover up the V openings as well as to prevent the collar 2D at the front end of outer barrel from opening which would loose the frictional contact of pinching members 22 and the lead L.

Figure 13:
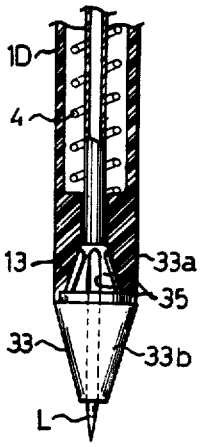
FIG. 13 is a longitudinal section showing the main parts of a fourth embodiment of the knock-out type automatic pencil of the present invention.

FIG. 13 depicts a fourth embodiment of the pencil of the present invention, wherein the press device 5A is simplified to have only a body 51A and an eraser 53A. The lead sharpener is omitted. The inner tube assembly 3 is screwed directly under the press device body 51A. Inside the front end of the outer barrel 1D, a tapered hole 13 is formed to match with the conical clamp 33*a*. The spring 4 forces the conical surface of clamp 33*a* to closely contact with the hole 13 to tightly clamp the lead L. Since the stopper collar 2 and control ring 37 such as mentioned in above embodiments are also omitted here, it is no longer possible to advance the lead by a designated length through every push of the press device, only when the press device is pushed to release the clamp 33, the lead would drop by gravity, and the desired length of projection of the lead should be adjusted by fingers or otherwise.

The above embodiments are given only for illustration and not by way of limitation, and modification will become evident to those skilled in the art which will fall within the scope of attached claims.

I claim:

1. Knock-out type automatic pencil comprising:

an outer barrel having a tapered bore at its front end to retain a conical clamp;

a tube assembly coaxial with, and movably retained within, said outer barrel and including a rear tube section projecting from the rear end of said outer barrel, which serves as a press means for depressing a spiral spring, a pencil-lead-receiving tube connected to said rear tube section, which pencil-lead-receiving tube is adapted to receive a single piece of pencil lead, a conical clamp for selectivity tightly clamping a single piece of pencil lead, said conical clamp having a plurality of longitudinal slots arranged symmetrically about a longitudinal axis of the conical clamp, said conical clamp being retained in the tapered bore at the front end of said outer barrel and being connected to said pencil-lead-receiving tube, and an inverted conically shaped head portion having a continuous outer peripheral surface and being connected to said clamp, and projecting from the front end of said outer barrel; and a spiral spring retained within said outer barrel by a spring retaining means located between the front end of said outer barrel and the front end of said rear tube section, said spring and said spring retaining means operating to support said pencil-lead-receiving tube and to urge said conical clamp into tight fitting engagement with the pencil lead projecting from said pencil-lead-receiving tube.

2. A knock-out type automatic pencil according to claim 1 wherein said spring retaining means comprises seats provided by first internal shoulders at the front end of said outer barrel and second external shoulders at the front end of said rear tube section of said tube assembly.

3. A knock-out type automatic pencil according to claim 2 wherein said rear tube section has a female-threaded longitudinal bore and said pencil-lead-receiving tube has an outer surface, a portion of which is male-threaded so that the pencil-lead-receiving tube may be screwed into the rear tube section.

4. An automatic pencil of the knock-out type, comprising:

an outer barrel having a longitudinally extending passageway both enlarged and tapered at a lower end of the outer barrel and enlarged at an upper end of the barrel;

a tube adapted to receive a single piece of lead, the tube being slidingly received within the passageway of the outer barrel;

conical clamp means for releasably clamping the single piece of lead, said conical clamp means including a member provided at a lower end of the tube and having an upper end which corresponds generally to the enlarged and tapered portion of the passageway of the outer barrel, said upper end of the member having a plurality of slots arranged symmetrically about a longitudinal axis of the member;

said member also including a lower portion having a continuous outer peripheral surface, said lower portion being generally conical in shape; and biasing means for urging the tube and conical clamp upwardly with respect to the outer barrel, said biasing means including a spiral spring carried by the tube within the passageway of the outer barrel.

* * * * *